US006971202B2

(12) United States Patent
Bender

(10) Patent No.: US 6,971,202 B2
(45) Date of Patent: Dec. 6, 2005

(54) GAS OPERATED ACTION FOR AUTO-LOADING FIREARMS

(76) Inventor: Terrence Bender, P.O. Box 240, 485 Ridgeview Cir., Hamel, MN (US) 55340

( * ) Notice: Subject to any disclaimer, the term of this patent is extended or adjusted under 35 U.S.C. 154(b) by 18 days.

(21) Appl. No.: 10/761,898

(22) Filed: Jan. 21, 2004

(65) Prior Publication Data

US 2005/0223613 A1 Oct. 13, 2005

Related U.S. Application Data

(60) Provisional application No. 60/442,760, filed on Jan. 27, 2003.

(51) Int. Cl.[7] ..... F41A 3/00
(52) U.S. Cl. ..... 42/16; 89/1.42; 89/188; 89/174
(58) Field of Search ..... 42/16; 89/1.42, 89/188, 174

(56) References Cited

U.S. PATENT DOCUMENTS

| | | | | |
|---|---|---|---|---|
| 1,924,692 A | * | 8/1933 | Loomis | 42/16 |
| 2,836,918 A | * | 6/1958 | Pula et al. | |
| 2,951,424 A | | 9/1960 | Stoner | 89/191 |
| 3,198,076 A | | 8/1965 | Stoner | 89/128 |
| 3,387,400 A | * | 6/1968 | Badali et al. | 42/16 |
| 4,022,105 A | | 5/1977 | White | 89/149 |
| 4,389,919 A | | 6/1983 | Kast et al. | 89/185 |
| 4,579,034 A | | 4/1986 | Holloway | 89/33.1 |
| 4,920,855 A | | 5/1990 | Waters | 89/172 |
| 5,117,735 A | * | 6/1992 | Flashkes | 89/188 |
| 6,091,944 A | * | 7/2000 | Friend | 42/16 |
| 6,189,253 B1 | * | 2/2001 | Knight et al. | 42/16 |
| 6,240,670 B1 | * | 6/2001 | Findlay | 42/16 |
| 6,293,040 B1 | * | 9/2001 | Luth | |
| 6,484,430 B1 | * | 11/2002 | Robinson et al. | 89/188 |
| 6,609,319 B1 | * | 8/2003 | Olson | 42/16 |

OTHER PUBLICATIONS

U.S. Appl. No. 60/442,760, filed Jan. 27, 2003, Bender.

* cited by examiner

*Primary Examiner*—Michael J. Carone
*Assistant Examiner*—Lulit Semunegus
(74) *Attorney, Agent, or Firm*—Vidas, Arrett & Steinkraus, P.A.

(57) ABSTRACT

A gas operated action for auto-loading guns may comprise a receiver, a biasing spring, a bolt-carrier reciprocable within the receiver, a bolt having a cam pin, and an action rod fixedly attached to the receiver. The cam pin may engage the action rod during recoil travel of the bolt and bolt-carrier, thereby preventing rotation of the bolt when the cam pin is engaged with the action rod.

24 Claims, 14 Drawing Sheets

3
13
15
14
16
6
24
21
12
20
17
27
34
26
29
30
22
18
19
23
25

28
40
41
28
56
48
32
36
33
58
55
54
57
35
39
37
53
31
38
59
50
46
43
45
51
44
49
52
47
42

64
61
21
63
64

62
21
83

21
63

61
60
21

48
65
69
66
67
68
58
32

84
65
58
32

32
70

66
68
65

43
42
49
71
72
53
52
51
50
59
47

43
77
76
42
ENGAGE & LOCK 77
43
76
42
UNLOCK & DISENGAGE 29
32
50
69
42
77
43

66
63
21
64
80
65
32
30
81
42
50

35
26

29
30
32
21
64
80
30
69
50
42
77
76
4
43

57
66
63
21
64
80
65
32
67
68
30
81
71
42
50
59

35
26
70
32

85
86
87
88
32
30
42
43
21
65
26
35
50

GAS OPERATED ACTION FOR AUTO-LOADING FIREARMS

CROSS-REFERENCE TO RELATED APPLICATIONS

This application claims the benefit of Provisional Patent Application No. 60/442,760 filed Jan. 27, 2003, the entire contents of which are incorporated herein by reference.

TECHNICAL FIELD

This invention relates to firearms for firing projectiles, and more specifically, in some embodiments, to shoulder-fired auto-loading, or semiautomatic rifles. In some embodiments, this invention is a propellant gas assisting cycling breech unlocking and locking system adapted for large calibers.

BACKGROUND OF THE INVENTION

All US patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

In the general area of auto-loading long guns, or rifles (arms not known as pistols, or handguns, but known as semi-automatic shoulder-fired rifles), many systems have been designed and proven related to small arms of generally small caliber. Many of these systems have had their success as military weapons procurements, some of which have migrated into the civilian sector.

Most of these auto-loading systems generally employ tapping the high-pressure bullet propellant gas somewhere between the barrel muzzle and the barrel chamber, after the passage of the bullet down the barrel and past the gas tapping port, and redirecting this tapped high-pressure gas to perform the useful work of releasing the breech lockup device. When the breech lockup device is released, the system further employs the latent propellant gas pressure in the barrel and chamber to expel the spent cartridge case from the chamber, which pushes back on the loading-unloading mechanism, which ejects the spent case from the receiver and generally resets the firing mechanism. This occurs over one half of the loading-unloading mechanism's reciprocating cycle. On the return cycle stroke, the loading/unloading mechanism strips an unfired cartridge from a detachable box magazine store inserted into the gun and positions the cartridge into the barrel chamber and relocks the breech. Manual manipulation of the trigger device by the shooter ignites the cartridge propellant, which burns very quickly, producing rapidly expanding hot gases, the developing pressure of which pushes the bullet out of the cartridge case and down the barrel. The gas also pushes against the cartridge case walls that seal against the barrel's chamber walls while pushing the case against the locked breech, and the cycle repeats as long as cartridges can be fed from the magazine and the operator activates the trigger device.

This system has undergone refinements over the years to improve its efficiency, reduce the size and weight of various guns employing it, and to reduction of certain manufacturing complexities and costs. The systems in use today are most especially applicable to small bullet calibers.

One of the more popular military guns in recent history to employ a variation of this system is the "AR-15" developed by Armalite in the 1950s and its designer, Eugene Stoner. The patents were subsequently sold to "Colt Firearms" and its many holders. The US military procured it as the M-16. This rifle design itself has undergone many refinements to improve its functional reliability, to expand its mission roles, and to reduce its manufacturing costs, yet the design's operable principles have not been improved. Today, many manufacturers sell their own variations of this reputable rifle fitted to several calibers from 0.223 to 0.308.

The present invention overcomes some of the undesirable features of the "AR-15" type design as applied to large caliber cartridges like the 0.50 caliber BMG (Browning Machine Gun) also known as 12.7×99 mm NATO. One could simply scale up the "AR-15" design to accommodate the larger cartridge but this would result in a rifle that was unduly large to comfortably handle and more expensive to manufacture than desired. The original "AR-15" design included additional features that were more suited to the highly mobile infantryman and should be considered superfluous to the necessarily much heavier rifle built around the 0.50 cal. BMG cartridge.

A feature-to-feature scale up of the "AR-15" design would result in a rifle that was too long and heavy for practical purposes and too expensive to manufacture. The larger cartridge requires a larger barrel. The larger barrel diameter and a greater length translate directly into greater rifle heft weight for that reason alone. It is no longer a light and easily managed off-hand shooting rifle. Some added weight, generally speaking, works to the shooter's advantage, as it tends to reduce the felt recoil and makes for a more stable shooting platform when used in conjunction with a bipod or bench rest. Additional weight is added still as the longer cartridge translates directly into a longer and heavier receiver and longer traverses of the action cycle. Add again to this, the larger and longer buffer and buffer tube requirements of the "AR-15" concept and the resulting uncomfortably long pull and it quickly becomes apparent that the scaled up design is unworkable. The subject improvements to the "AR-15" functional concepts in view of larger calibers are described below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

The present firearm design is an improvement of the prior art typified by the "AR-15" design concept and is suitable to larger rifle cartridges, such as the 0.50 cal. BMG. Familiarity with the "AR-15" operable principles and design is assumed for the purposes of the following discussion. Although the following disclosure makes specific reference to embodiments of the invention suitable for firing a 0.50 cal. BMG, the invention is not limited to such designs. The present invention may be configured for use with projectiles of any desired caliber.

A desirable feature of the "AR-15" design is the ability to separate the rifle into two separate pieces (upper receiver-barrel and lower receiver-stock) for ease of maintenance. A design objective for various embodiments of the present invention, such as an embodiment suited for firing the 0.50 cal. BMG, was the facility to easily separate the rifle into two main parts for maintenance and portability. The overall length of the assembled rifle may be too large to conveniently case for storage or transportation. So, the rifle was designed with a reversibly removable barrel assembly. The rifle then breaks down into two components. The receiver-stock assembly and the barrel assembly in their respective overall length proportions are now more similar to the "AR-15" design than would be possible with a feature-to-feature design implementation of the "AR-15." This works well with the 0.50 cal. BMG rifle concept as the barrel of the present design is disproportionately long with respect to the rest of the gun.

The "AR-15" charging handle concept was discarded in the subject design for three reasons. Firstly, in order to charge the light "AR-15" rifle, the shooter must remove the rifle's butt stock from the shoulder. The right-handed shooter grasps the charging handle that exits through a hole on the top-rear portion of the upper receiver, wherein it rides underneath the carry-handle. The shooter pulls with the right hand, while grasping the rifle, usually by the barrel shroud, in the left hand and pulls rearward with his right. At its fullest extent, the shooter then releases the handle to strip a cartridge from the magazine and place it in battery. This is not practical for a 0.50 cal. BMG rifle due to its sheer heft weight. It seemed more practical to pull on a charging handle with the right hand while the rifle was still in the shoulder pocket. This handle would be to the right side of the receiver for the right-handed shooter.

Secondly, it should be possible to turn the semi-auto gas assist off and cycle the rifle manually by pulling on the same charging handle in the new and improved concept, something that is not possible with the "AR-15" concept. This is desirable for accuracy driven applications that allow operation of the rifle like a bolt-action without having to remove the rifle from the shoulder, or take the eyes off the target.

Thirdly, the "AR-15" bolt-charging handle that fits underneath a carrying handle, or a "flat-top" accessory rail in some models, pulls on a gas-plumbing appendage attached to the bolt-carrier. This gas-plumbing appendage directs propellant gas from the barrel into a piston-cylinder arrangement formed between the bolt and the bolt-carrier. When pressurized gas enters into this piston- cylinder, it pushes against the rear of the bolt-carrier cylinder, which bolt-carrier is free to translate to the rear of the receiver, said pressurized gas also acting on the rear of the bolt piston, which bolt is not free to translate while in battery, since it pushes against the chambered cartridge case at the forward end, but is free to rotate. A lateral cam pin is held in the bolt and extends outward and rides in a helical cam slot in the bolt-carrier. When the bolt-carrier translates to the rear, it forces the cam pin of the bolt to rotate the bolt. As the bolt rotates, locking lugs on the bolt and the barrel extension disengage. The latent gas pressure in the chamber now pushes the bolt-carrier assembly fully to the rear to cycle the auto-loading action. The gas-plumbing appendage and a portion of the bolt cam pin ride in a slot broached internally to the upper receiver extending into the body of the carry handle. The gas-plumbing appendage now functioning as a sliding key in the slot prevents the bolt-carrier from rotating with respect to the upper receiver under the action of the unlocking-locking cam pin. This slot feature requires a complex broaching process during manufacture of the upper receiver to make the internal slot in the carry handle or "flat-top." This was thought to be unduly cumbersome and expensive for the present design. It was a design objective of the present design that all the major machining operations would be variations of lathe turning and end milling.

The machining objective required that the gas-plumbing implementation concept of the "AR-15" gas system, between the barrel gas tube and the bolt and bolt-carrier inclusive, be rearranged to fit within the new simplified form factor. In the "AR-15" design, threaded fasteners attach the gas-plumbing appendage to the bolt-carrier. It reciprocates along with the bolt-carrier and also functions as a key running in the broached receiver slot that prevents the bolt-carrier from rotating. When the bolt is in battery, the forward feature of the gas-plumbing appendage receives the barrel gas tube. The fit between the gas tube and the gas-plumbing appendage is close enough to prevent unwanted gas leakage during pressurization of the gas plumbing. The other end of the gas-plumbing appendage's plumbing connects with a hole in the bolt-carrier that directs the pressurized gas flow to the bolt and bolt-carrier piston-cylinder chamber.

To facilitate simplified manufacture by machining of the receiver and bolt-carrier group, the arrangement of the "AR-15" concept was altered for the present design. The new implementation entails reversibly receiving the barrel gas tube into the scope mount base when the barrel assembly is attached to the receiver. Two blind holes drilled at right angles into the scope mount base facilitate the turn of the gas flow from the horizontal barrel and gas tube vertically down into the new gas-elbow, which replaces the gas-plumbing appendage in the "AR-15" concept. This gas-elbow is attached to the receiver tube by threaded fasteners. The elbow fits through a recessed slot in the receiver tube. The elbow conducts pressurized gas vertically down and then horizontally and to the rear through a hole and a machined tubular feature that is received by a close-fitting horizontal blind hole drilled in the forward end of the bolt-carrier. The pressurized gas traveling horizontally through this hole in the bolt-carrier is turned down and into the piston-cylinder chamber with a through cross hole that is plugged on the outside of the bolt-carrier with a threaded plug to prevent pressurized gas from escaping the gas plumbing. This rearrangement was necessary to simplify the design as stated earlier and to reach farther to the rear where the piston-cylinder chamber is located due to the longer 0.50 cal. BMG cartridge.

An added design objective was the need for adjusting the pressurized gas flow to variously loaded 0.50 cal. BMG cartridges. The variability of the powder charge among commercially loaded and hand-loaded ammunition obviated the suitability of a fixed gas flow system. Some loads would be found to adequately cycle the action; others would not. Some loads could even cause damage to the action by over pressurization. So, it was necessary to include an adjustable gas valve. This feature, consisting of a spring-loaded screw with position detentes, was installed on the accessory mount base for easy access. The screw tip would either adjustably open up or close down the pressurized gas path. Without a change to the gas flow arrangement of the "AR-15" concept to the present design, it would not have been possible to place the gas adjustment feature on the receiver for easy access while in the shooting position with the rifle at the shoulder.

An added design objective for the present invention was to provide an accessory-mounting system with a variable declination angle to accommodate optical scope sighting systems with limited vertical adjustment. It is not uncommon for shooters employing the 0.50 cal. BMG cartridge to reach out to targets over a mile distant. In these cases, the barrel must be elevated, since the bullet trajectory is seen to drop dramatically as the bullet nears the target. In all cases this requires the optical scope to be dialed down to bring the crosshairs on the target. In most scopes, there is not enough vertical adjustment available. So, the accessory-mounting rail must provide additional vertical adjustment capability. This is accomplished by machining a declination angle on the accessory-mounting base to which is fastened the accessory-mounting rail. Since fasteners fix these components, it becomes a very stable platform for repeatable placement and removal of optical systems without the loss of "zero."

It was a design objective for certain embodiments of the present invention to include the non-rotating translation feature of the bolt-carrier key and the charging handle slot of the "AR-15" concept within the ejection port for the ergonomic reasons discussed above. Due to the already long length requirement of the ejection port needed to accommodate the longer brass case of the 0.50 cal. BMG, it seemed advantageous to lengthen the ejection port still further with this said purpose in mind. Since the receiver tube was already thick-walled to accommodate the many threaded fasteners, and for other strength considerations, this objective was accomplished without unduly weakening the structural integrity of the receiver tube.

As mentioned above, the bolt cam pin of the "AR-15" design would be rotated into alignment with and glide within the confined space of the broached slot in the upper receiver whenever the bolt was out of battery. When the bolt-carrier reciprocates, a rectangular feature on the bolt cam pin would ride within the walls of this slot as well. This same rectangular feature was sized to closely fit within the slot and thereby provide two large bearing surfaces to reduce wear over time. This feature ensured that whenever the bolt was out of battery the bolt could not rotate with respect to the bolt-carrier or the upper receiver, since the bolt-carrier was also rotationally fixed as mentioned above. If this feature were absent, whenever the bolt met some translational resistance, it would tend to rotate under the action of the bolt cam pin with the helical slot in the bolt-carrier. This resistance would most likely occur when the bolt was stripping a cartridge from the magazine store. Consequently, when rotated, the bolt lugs would meet the barrel extension lugs and interference would occur that prevented lockup engagement of the lugs. Since the broached slot in the upper receiver has been eliminated, a new design concept was required to prevent bolt rotation during bolt-carrier reciprocation.

It was a design objective of the present design to provide features on the bolt-carrier and bolt cam pin that prevented rotation of the bolt when it was not in battery that did not rely on an upper receiver feature. This means was provided by inclusion of a so-called action rod whose one end was fixed to the recoil pad assembly on the rear-most end of the receiver tube. The same action rod would pierce the cam pin through a hole that aligned with a through hole in the bolt carrier whenever the bolt was rotated out of battery during bolt-carrier translation to the rear and near the forward extreme. When the bolt-carrier is reciprocating, the rod always pierces the cam pin. The rod also always pierces the bolt-carrier. Since the rod slides in a close fitting hole in the bolt-carrier and a close fitting hole in the bolt cam pin, the bolt is rotationally fixed to the bolt-carrier and cannot rotate. In this orientation, the bolt lugs are aligned with the corresponding gaps between the barrel extension lugs, i.e., they are in a disengaging rotational orientation. When the bolt-carrier is moving to push a cartridge into battery the bolt lugs pass by the barrel extension lugs until the cartridge experiences some resistance to movement in the barrel chamber. During this movement, as soon as the bolt lugs are rotationally constrained by the nearby barrel extension lugs, the cam pin hole becomes free of the rod, removing that constraint to bolt rotation. As the bolt-carrier moves still further into battery, the bolt still cannot rotate due to the interfering lug constraints. The bolt is moved forward with the bolt-carrier by means of the bolt cam pin, which bears against the wall of the helical slot in the bolt-carrier. When the cartridge is fully in battery, the lugs of the bolt are now free of the rotational constraint of the barrel extension lugs, because it has translated just far enough to be clear. As the bolt-carrier moves still further, the rear-most helical slot wall bears against the cam pin and causes the bolt to rotate and as it does so, the bolt lugs and barrel extension lugs are aligned to provide the requisite translation lockup (lug-to-lug interference) for safe ignition of the cartridge. The spring force of the recoil spring, which propelled the bolt carrier into battery, now forces the bolt-carrier against the bolt by means of the cam pin seated against the rear-most cylindrical surface of the helical cam slot, which in turns bears the bolt face against the cartridge's base and forces the cartridge, in turn, solidly into the barrel chamber. Reverse this process to unlock the lugs and eject the cartridge without allowing rotation of the bolt during bolt-carrier reciprocation just reverse this process.

Placing the bolt rotation features entirely within the bolt-carrier meant that the bolt-carrier diameter should be large enough to accommodate all the necessary features. The proportionally much larger outside diameter of the new bolt-carrier over the scaled up "AR-15" concept to the larger cartridge, allows for larger sliding support bearing surfaces between the bolt-carrier and the receiver tube, an advantageous development that tends to reduce wear. The oversized bolt-carrier diameter also allowed for more desirable clearance features to accommodate a dual stack magazine with large cartridge retention lips.

The "AR-15" design includes a magazine well that is integral with the lower receiver and protrudes conspicuously beneath it. It was a design objective of the present invention to eliminate this feature in the interests of reducing the size of the gun receiver and the associated material and manufacturing costs.

The "AR-15" design employs Aluminum net-shape metal forgings machined with secondary features for the upper and lower receivers to reduce the manufacturing costs. It was a design objective of the present design to machine the gun's upper receiver from round or tubular material and the gun's lower receiver from plate material without the need of metal forgings, since this design's net shape is essentially cylindrical.

The implementation of these design objectives is a rifle with the following features: a removable barrel assembly that attaches directly to the receiver tube with a threaded barrel nut for compact storage or stowage; a receiver that has a general cylindrical shape for easy machining; a tubular receiver with thick walls to allow for the attachment of the lower receiver by threaded fasteners; a tubular receiver with thick walls to allow for the machining of a slot for the stable reception of a detachable box magazine; a tubular receiver with thick walls to allow for the attachment of a fixed propellant gas-elbow that is attached with threaded fasteners to the receiver and is received internally by the bolt-carrier; a tubular receiver with thick walls that allows attachment of an accessory mount with threaded fasteners that contains features to mount an optical target scope, etc., to hold the bolt-carrier in an "open" position, to direct propellant gases from the barrel gas transfer tube to the propellant gas-elbow, to hold a gas meter screw that allows adjustment of the gas flow to the bolt-carrier; a tubular receiver with thick walls to allow for the machining of a long rectangular ejection port that also serves as the slot feature for the bolt charging handle key that prevents the bolt-carrier from rotating without unduly weakening the receiver tube; a rod that is fixed in a rearward position with respect to the receiver tube and always passes through the bolt-carrier and the bolt cam pin locking the rotational position of the bolt only when it is not in battery; a lower receiver that contains the fire control mechanism and is generally a rectangular shape; a bolt and bolt-carrier with an integral piston-cylinder pressure chamber; a bolt with battery locking lugs that can be rotated with a cam pin by a helical cam slot in the bolt-carrier; a gas plumbing system that does not require an "AR-15" type carry handle or other features that would add to the size, weight, or manufacturing expense of the gun; a suite of major machined features comprising a useful net shape that requires only simple lathe turning and end milling operations; and finally, a large caliber rifle that is as small and light as practical.

U.S. Pat. No. 4,579,034 to Holloway, U.S. Pat. No. 4,920,855 to Waters, U.S. Pat. No. 4,022,105 to White and U.S. Pat. No. 4,389,919 to Kast et al. are incorporated herein by reference in their entireties.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there are illustrated and described various embodiments of the invention.

BRIEF DESCRIPTION OF THE DRAWINGS

So that the manner in which the above recited features, advantages, and objectives of the present invention are attained and can be understood in detail, more particular description of the invention, briefly summarized above, may be had by reference to the embodiments thereof, which are illustrated in the appended drawings, which drawings form a part of the specification.

It is to be noted, however, the appended drawings illustrate only typical embodiments of this invention and are therefore not to be considered limiting of its scope, for the invention may admit to other equally effective embodiments. Referring now to the accompanying drawings, which are for illustrative purposes only.

DETAILED DESCRIPTION OF THE PREFERRED EMBODIMENT

Figure 1:
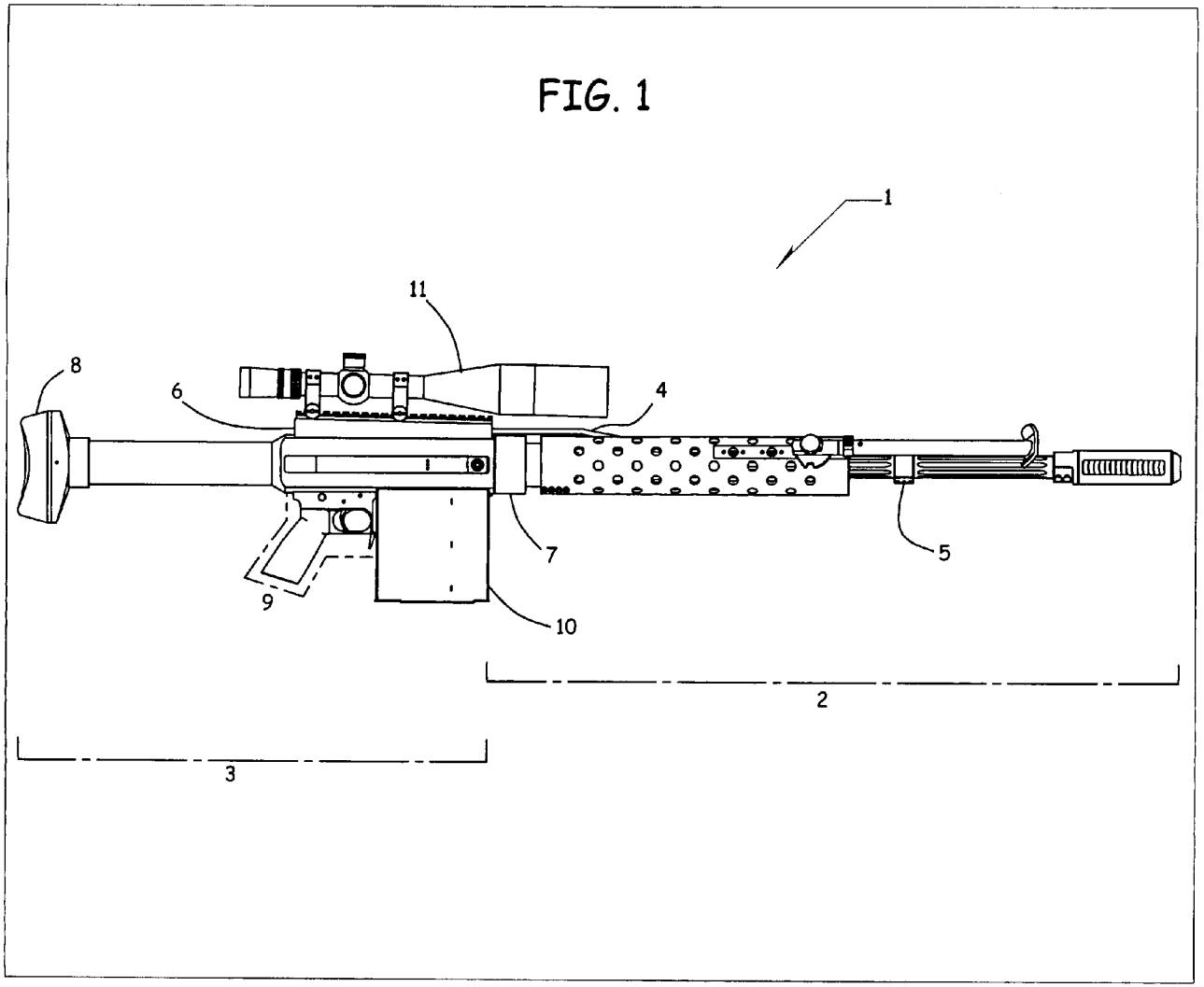
FIG. 1 is side view of an exemplary large caliber rifle that employs the subject invention.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

The preferred embodiment of the present invention is evident in a rifle 1 shown in FIG. 1. The rifle 1 comprises two major subassemblies, the barrel subassembly 2 in a forward position and the receiver assembly 3 in a rearward position, which positional convention is hereinafter made by frequent reference.

The barrel assembly 2 is conspicuous with a gas tube 4. Said gas tube 4 directs propellant gas from a cross-hole port in the barrel wall nearer its muzzle through a barrel gas collar means 5 (not shown in detail) into the receiver assembly 3. The gas tube 4 enters the receiver assembly 3 through an accessory mount base 6, which directs the propellant gas through some internal features into the receiver.

The barrel assembly 2 is also conspicuous for a rifle takedown nut 7, which holds the barrel assembly 2 to the receiver assembly 3.

The receiver assembly 3 is conspicuous for a rifle recoil pad 8, a lower receiver group 9 with hand-grip, trigger, and fire-control parts, a detachable box magazine 10, and an optical target scope 11.

Figures 2A, 2B:
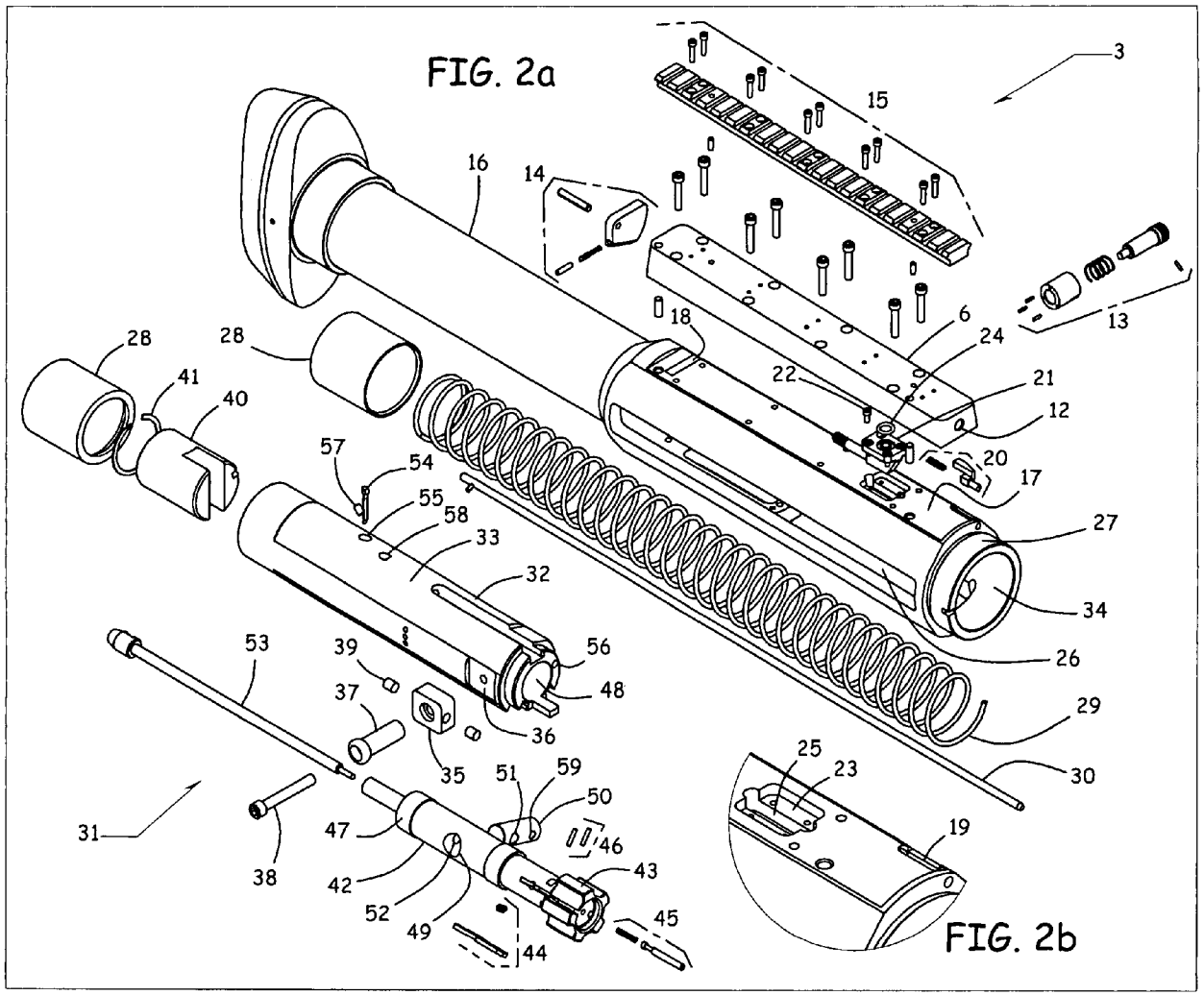
FIG. 2*a* is an exploded view of the preferred embodiment's receiver portion of said rifle shown in FIG. 1. Said receiver portion having attached to the top an accessory-mounting base and rail, and at the rear, a recoil pad and attachment means, and inserted internally into said receiver, a bolt-carrier and bolt with compression spring and other parts for the proper functioning thereof.
FIG. 2*b* is a detail view of the gas-elbow and receiver shown in FIG. 2*a*.
Figures 3A, 3B, 3C, 3D:
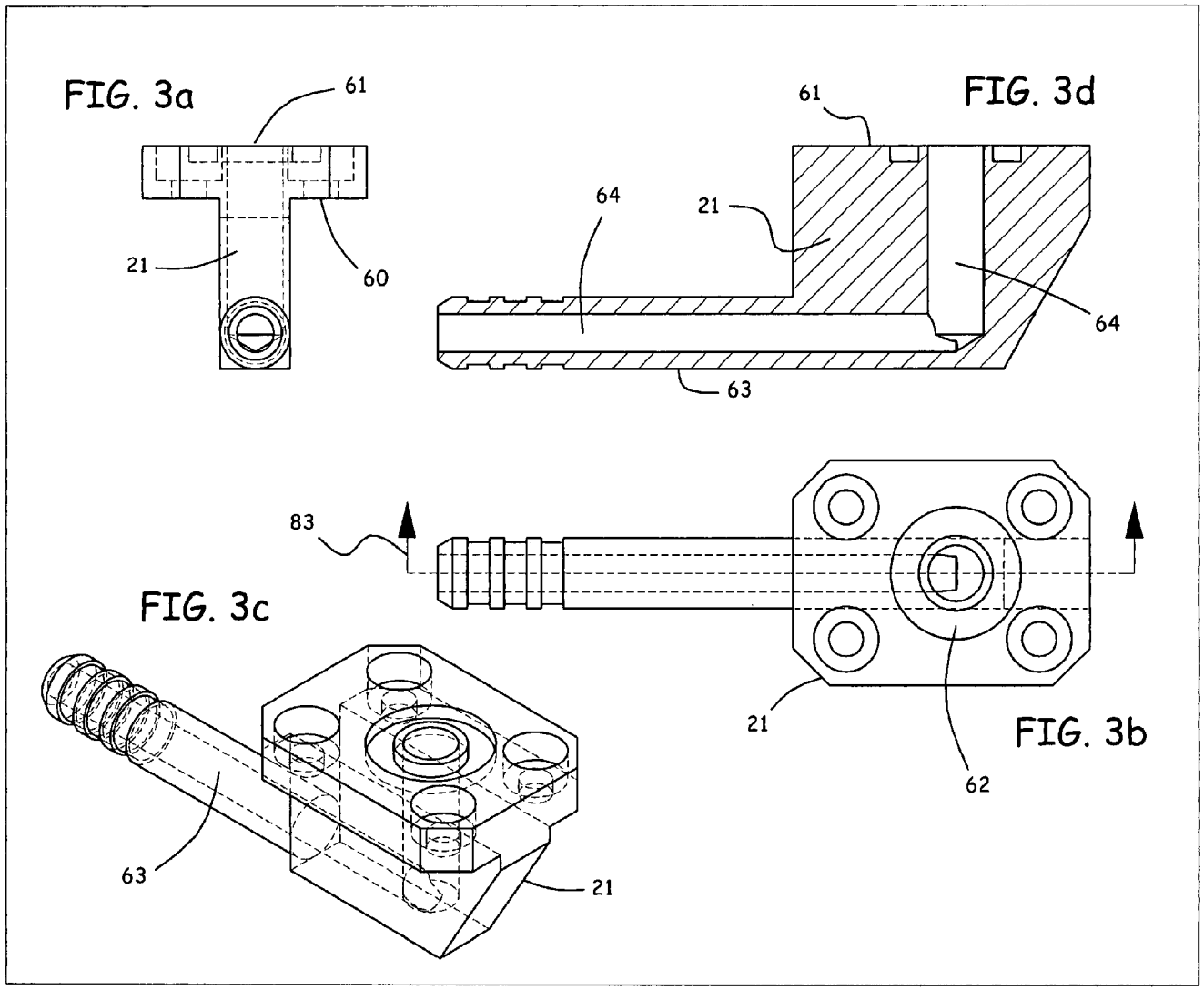
FIG. 3*a* shows an end view of the gas elbow.
FIG. 3*b* shows a top view of the gas elbow.
FIG. 3*c* is an three-dimensional perspective view of the gas elbow.
FIG. 3*d* shows a section view of the gas elbow along the section plane denoted in FIG. 3*b*.

The receiver assembly 3 is shown in an exploded parts view in FIG. 2*a* less the lower receiver group 9, the detachable box magazine 10, and the optical target scope 11. The accessory mount base 6 is shown with a gas tube hole 12 in the front that receives the gas tube 4 mentioned above. This gas tube hole 12 has a straight diameter large enough to permit easy removal and insertion of the gas tube 4 that is parallel to it in orientation but tight enough to prevent unwanted leakage of propellant gases. The accessory mount base 6 has other features: one that allows installation of a gas valve stem 13 with respective adjustment detente features; another with a bolt-open catch means 14; and still another with an accessory-mounting rail 15 with fasteners and alignment dowel pins.

The largest part in receiver assembly 3 is the receiver 16. The receiver 16 has a receiver accessory mount 17 to which attaches the accessory mount base 6 with fasteners and alignment dowel pins. It has a bolt-open catch slot 18 near the rear portion that partially receives the bolt-open catch means 14. It has a slot and through- hole feature, takedown nut keeper slot 19 (see FIG. 2*b*), in which is seated a takedown nut-keeper means 20 that prevents the rifle takedown nut 7 from vibrating loose during successive rifle firings. The takedown nut keeper means 20 is itself prevented from falling out of the takedown nut keeper slot 19 by the accessory mount base 6, which is fastened to the receiver 16 over the top of it.

Propellant gas entering the accessory mount base 6 through the gas tube 4 inserted into gas tube hole 12 is redirected downward into the gas-elbow 21. The gas-elbow 21 is placed in the gas-elbow pocket 23 (see FIG. 2*b*) and fixed in place with gas-elbow fasteners 22. A gas leakage seal is obtained between the flat underside of the accessory mount base 6 and the gas-elbow 21 by a gas-elbow seal means 24. A gas-elbow slot 25 (see FIG. 2*b*) is machined in the upper wall of the receiver 16 in the bottom of the gas-elbow pocket 23 (see FIG. 2*b*). This allows for reception of the gas-elbow 21. In this manner, gas entering the receiver assembly 3 may exit the assembly through the gas-elbow 21. More details concerning gas-elbow 21 will be described below.

The ejection port 26 is visible as a long rectangular slot in the side of the receiver 16. Also noticeable is the receiver takedown thread 27 to which the rifle takedown nut 7 is fastened when the barrel assembly 2 is attached to the receiver assembly 3.

Internal to the receiver 16 is installed an action spring cap 28, an action spring 29, another action spring cap 28, and an action rod 30. The action rod 30 may be secured or fixed in place by attachment to the receiver 16. For example, in some embodiments, a recoil plate may be removably secured to the rear of the receiver 16. The recoil plate may be used to contain the action spring 29, bolt-carrier 31, and various other parts within the receiver 16. The action rod 30 may be affixed at one end to the recoil plate. In another embodiment, the rear end of the receiver 16 may include a permanent end cap as opposed to a recoil plate. The action rod 30 may attach to the end cap. The action rod 30 may also be affixed to the receiver at any location suitable so as not to interfere with operation of a bolt-carrier 31 as described herein.

The action rod 30 may be secured using any appropriate method, such as a pinned connection, a threaded engagement, and the like. The action rod 30 may comprise any suitable shape, having any suitable cross-section. The action rod 30 desirably prevents rotation of a bolt 42 when the action rod 30 is engaged with a cam pin 50 as described herein.

A bolt-carrier assembly 31 may be inserted into the receiver 16 from the rearward end after installation of the action spring 29, action spring caps 28, and the action rod 30. The bolt-carrier 32 is the major component of the bolt-carrier assembly 31. A bolt-carrier bearing 33 rides on the receiver bolt-carrier bearing 34 of the receiver 16 and can reciprocate in the forward and rearward directions. The bolt- carrier 32 is prevented from rotating about its axis within the receiver 16 by the charging handle key 35, which is seated in the bolt-carrier 32 by means of a charging handle key pocket 36, and which simultaneously closely fits through and is retained within the rectangular ejection port 26, and which charging handle key 35 is clamped to the bolt-carrier 32 by means of the charging handle 37 and the charging handle fastener 38. Said charging handle key 35 having provision for installation of charging handle cushions 39 that cushion against shock should the charging handle key 35 strike the ends of the ejection port 26.

Installed within the rear portion of the bolt-carrier 32 is a lockup inertial mass 40 and a lockup mass retention means 41. The lockup inertial mass 40 assists in driving the bolt-carrier assembly 31 into battery during action cycling and is meant to replace the buffer assembly of the "AR-15" concept.

Bolt 42 is also evident in FIG. 2*a*. Notice the bolt lugs 43, which will be described in more detail below. Fitted to the bolt 42 is a cartridge case extraction means 44 and a plunger-type cartridge case ejection means 45 fixed in their places with pins 46.

The bolt 42 is inserted into the forward end of the bolt-carrier 32, rear end first. Bolt bearing surface rings 47 ride on the bolt-carrier bolt bearing 48. The bolt cam pin hole 49 is aligned with a helical slot on the bolt-carrier 32 (described below). A cam pin 50 is inserted into and through the helical slot of the bolt-carrier 32 from the outside and into the bolt cam pin hole 49 of the bolt 42. When the cam pin firing pin hole 51 aligns with the bolt firing pin hole 52, the firing pin 53 can be inserted into the rearmost end of the bolt 42 through the bolt firing pin hole 52 and through the cam pin firing pin hole 51 thereby retaining the cam pin 50 in the bolt 42 and the bolt 42 in the bolt-carrier 32. Firing pin retention pin 54 is inserted into the bolt-carrier 32 through the firing pin retention pin hole 55 and retains the firing pin 53 in the bolt-carrier assembly 31.

Bolt-carrier 32 has an additional hole, bolt-carrier action rod hole 56, which receives the action rod 30 described in more detail below.

Bolt-carrier plug 57 is a threaded plug that screws into the bolt-carrier plughole 58 and is used to seal the gas pathway, described in further detail below.

Bolt cam pin 50 has an additional hole, cam pin action rod hole 59, which receives the action rod 30 described in more detail below.

FIGS. 3*a*, 3*b*, 3*c*, and 3*d* show detail views of the gas-elbow 21. Gas- elbow seat 60 (see FIG. 3*a*) is fastened against the gas-elbow pocket 23 (not shown) using gas-elbow fasteners 22 (not shown). The gas-elbow top 61 (see FIG. 3*a*) of the gas-elbow 21 may be parallel to the receiver accessory mount 16 (not shown) and slightly below flush to allow placement of the accessory mount base 6 (not shown) to the receiver accessory mount 16 without interference. Gas-elbow seal means 24 (not shown) seated in the gas-elbow seal groove 62 (see FIG. 3*b*) prevents gas leakage at this interface. A gas-elbow gas tube 63 (see FIG. 3*c*) is integral to the body of gas-elbow 21. Gas-elbow gas way 64 (see FIG. 3*d*, section view along section plane 83 of FIG. 3*b*) is created by intersecting cross-holes and conducts gas from the gas-elbow top 61 through and out of the gas-elbow tube 63 and into the bolt-carrier 32 (not shown), discussed in more detail below.

Figures 4A, 4B, 4C, 4D:
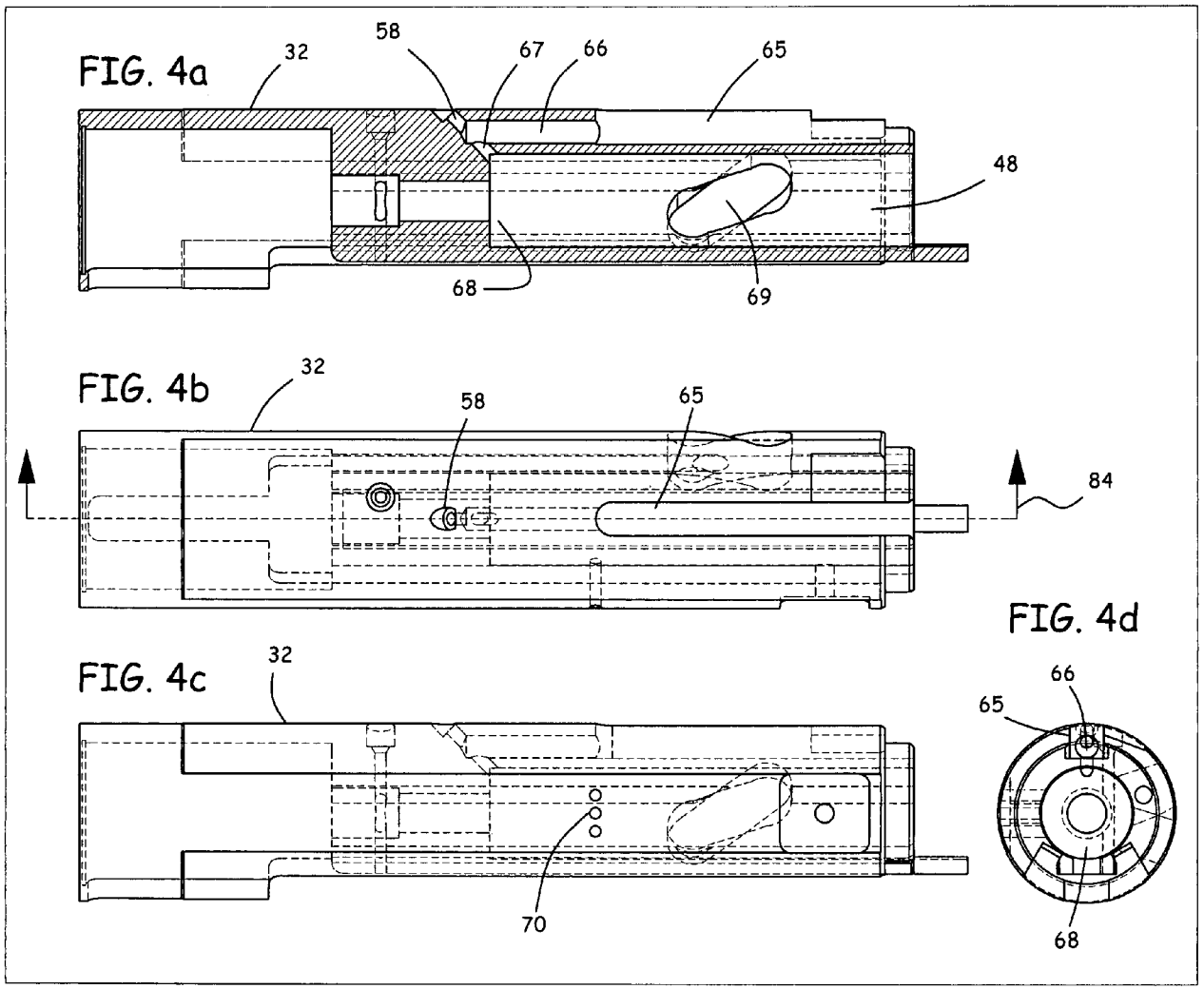
FIG. 4*a* shows a section view of the bolt-carrier taken along the section plane shown in FIG. 4*b*.
FIG. 4*b* shows a top view of the bolt-carrier.
FIG. 4*c* shows a side view of the bolt-carrier.
FIG. 4*d* shows a forward end view of the bolt-carrier.

FIGS. 4*a* (where the section view is taken along section plane 84 of FIG. 4*b*), 4*b*, and 4*c* show detail views of the bolt-carrier 32. Some new features are highlighted. Bolt-carrier gas-elbow clearance slot 65 (see FIGS. 4*a*, 4*b*, and 4*d*) receives the base of the gas-elbow 21 (not shown) including the gas-elbow gas tube 63 (not shown). Bolt-carrier gas port 66 (see FIGS. 4*a* and 4*d*) receives the gas-elbow gas tube 63 when the bolt-carrier 32 is in battery. Gas exiting the gas-elbow gas tube 63 is directed through the bolt-carrier gas way 67 (see FIG. 4*a*) into the bolt-carrier cylinder 68 (see FIGS. 4*a* and 4*d*), a confined expandable volume defined by the bolt 42 (not shown) described below. Gas is prevented from leaking from the bolt-carrier gas way 67 by insertion of the bolt-carrier plug 57 (not shown) into the bolt-carrier plughole 58 (see FIGS. 4*a* and 4*b*). The bolt-carrier cam slot 69 (see FIG. 4*a*) is now visible through which the bolt cam pin 50 (not shown) is inserted during assembly with the bolt 42 (not shown). Bolt-carrier gas vent 70 (see FIG. 4*c*) serves to depressurize the bolt-carrier cylinder 68 chamber of propellant gas once the bolt-carrier 32 has been cycled out of battery and is described in more detail below.

Figures 5A, 5B:
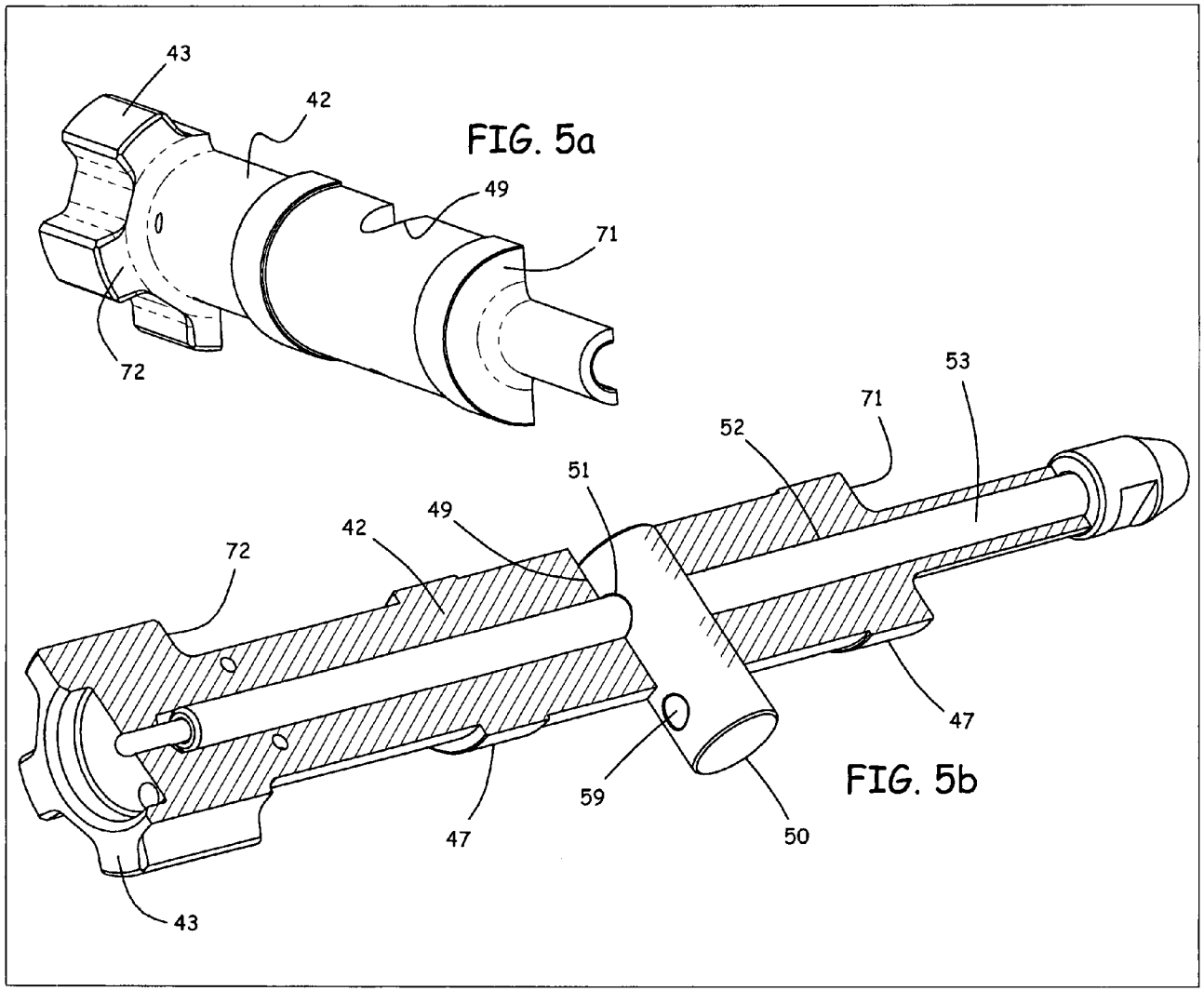
FIG. 5*a* shows a three-dimensional, cutaway, perspective view of the bolt.
FIG. 5*b* shows a three-dimensional, cutaway, perspective view of the bolt assembly.

FIGS. 5*a* and 5*b* show cutaway views of the bolt 42 with the cam pin 50 (see FIG. 5*b*) inserted in the bolt cam pin hole 49 and retained in place by the firing pin 53 inserted through the bolt firing pin hole 52 and the cam pin firing pin hole 51. A cam pin action rod hole 59 is also shown and will be explained in more detail below. Bolt bearing 47 allows for translation and rotation of the bolt 42 within the bolt-carrier 32 (not shown) and is described in more detail below. An annular flat surface called the bolt piston face 71 (see FIG. 5*b*) on the rear end of the bolt 42 will be explained in more detail below. Note again bolt lugs 43 (see FIGS. 5*a* and 5*b*). An annular flat surface on the rear end of said bolt lugs 43 and called the bolt lug bearing face 72 (see FIG. 5*a*) is that part of the bolt lugs 43 surface that engages the barrel extension lugs described below.

Figure 6:
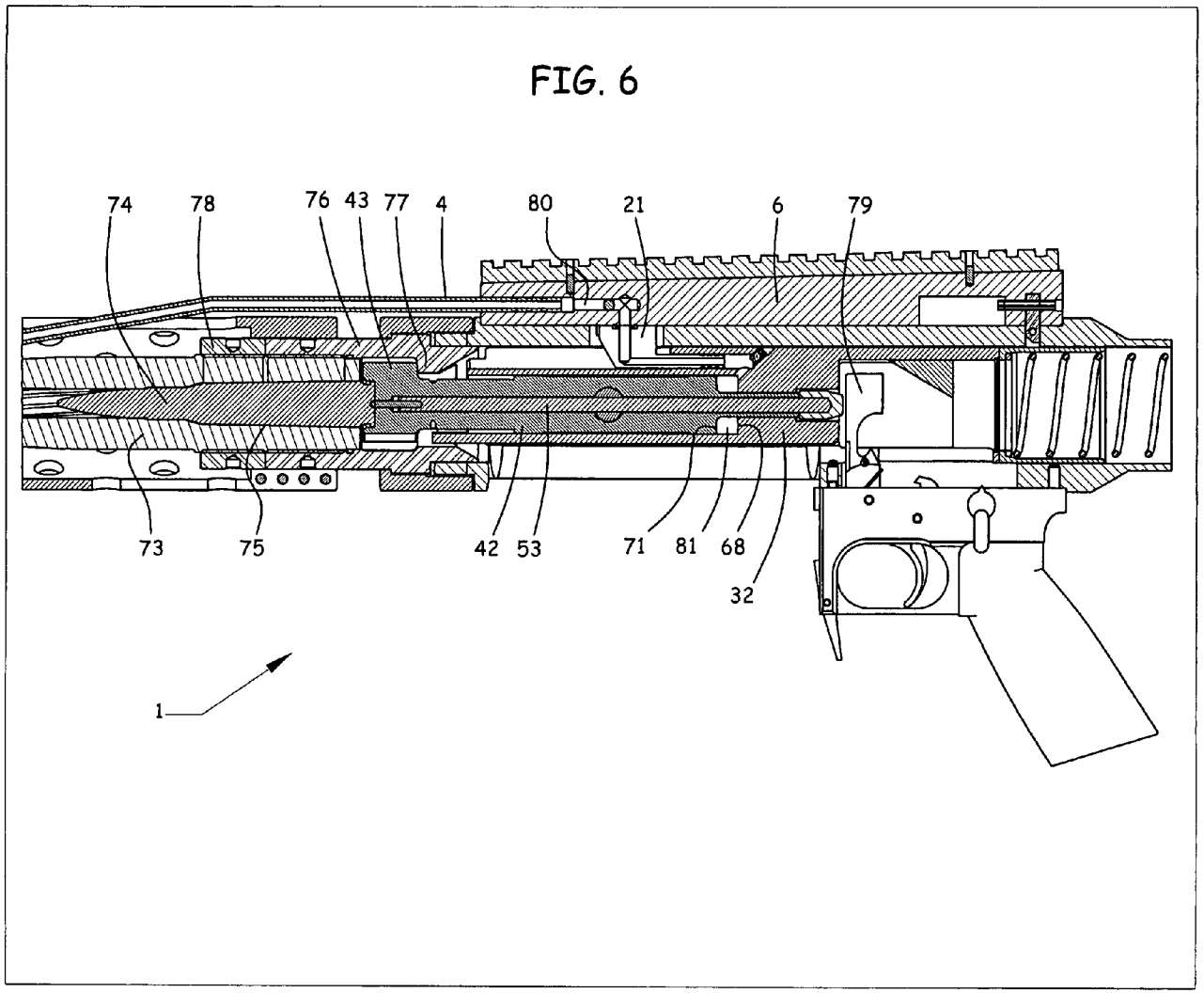
FIG. 6 is a side, longitudinal, partial, cross section view of said rifle's gas assisted cyclic action. Details are shown, which will illustrate the gas pressurization pathway and other features proper to its functioning and their relationship to other general rifle features.

FIG. 6 is a partial cross section view of the rifle 1 with the subject action invention in battery. Several additional parts are identified. Barrel 73 is shown with a cartridge 74 positioned in the barrel chamber 75. Attached to the barrel 73 is the barrel extension 76 with some of the barrel extension lugs 77 visible. The barrel extension 76 is threaded to the barrel 73 and locked in place with a barrel extension jam nut 78. The bolt 42 and bolt-carrier 32 are shown to be in battery with the bolt lugs 43 in lockup with the barrel extension lugs 77. When the hammer 79 strikes the firing pin 53, the propellant powder in the chambered cartridge ignites, generating the pressure that sends the bullet down the barrel and past the barrel gas port. High-pressure propellant gas can now travel back through the barrel gas port, enters the gas tube 4, then enters the accessory mount base 6, passes on through the accessory mount base gas way 80, through the gas-elbow 21, and eventually enters the piston cylinder chamber 81 formed by the bolt piston face 71 and bolt-carrier cylinder 68 upon which the propellant gas works to release the locked up lugs as will be described below.

Figures 7A, 7B:
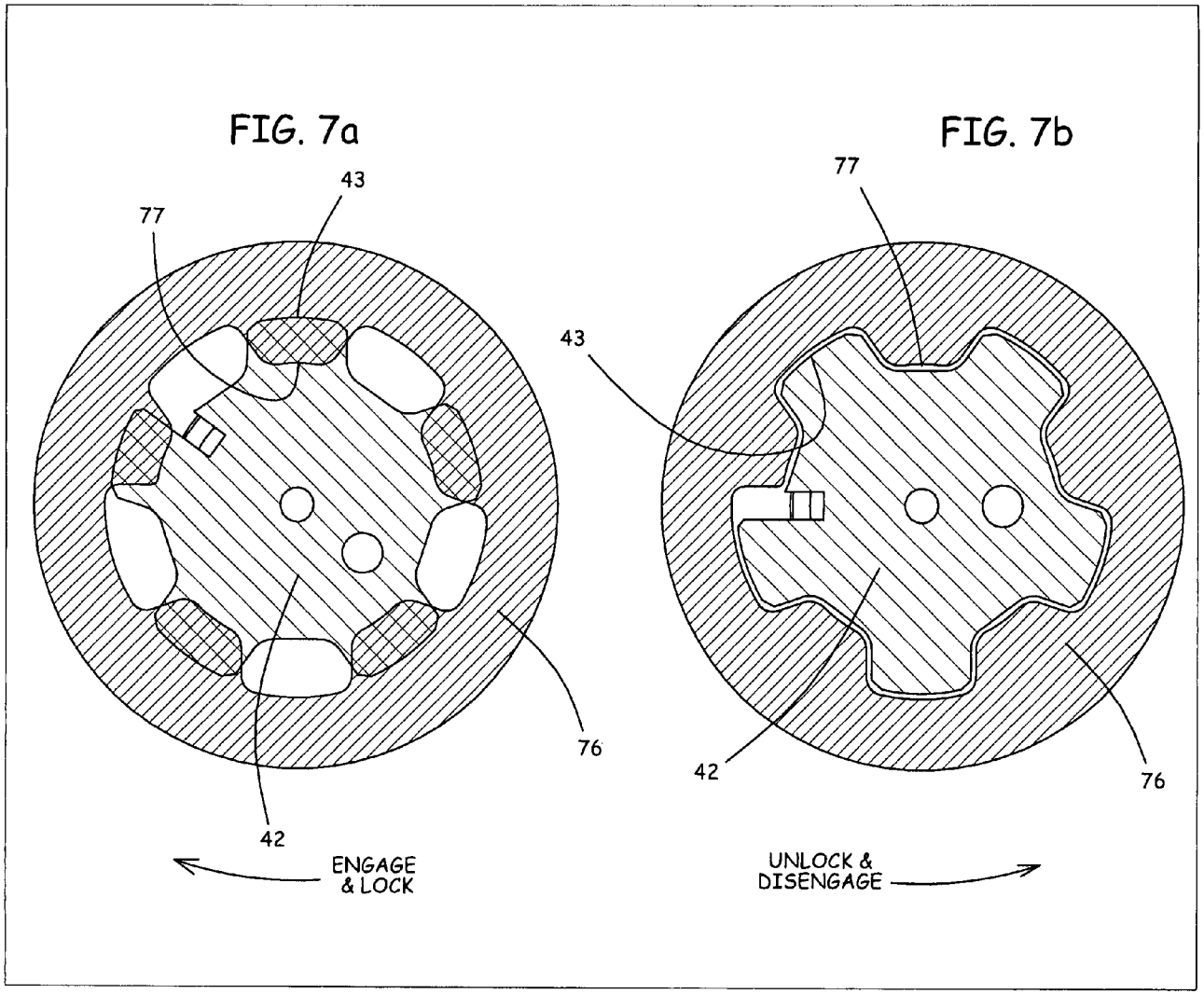
FIG. 7*a* shows a superimposing, cross-sectional view of the bolt and barrel extension locking lugs when the lugs are in the breech lockup mode.
FIG. 7*b* shows a superimposing, cross-sectional view of the bolt and barrel extension locking lugs when the lugs are in the breech unlock mode.

FIGS. 7*a* and 7*b* illustrates the orientation of the bolt lugs 43 and the barrel extension lugs 77 during lockup (see FIG. 7*a*) and disengagement (see FIG. 7*b*). The bolt 42 must be rotated into and out of battery with respect to the stationary barrel extension 76 when the subject action is cycled. The following figures will illustrate how the above-mentioned parts function in this preferred embodiment.

Figures 8A, 8B, 8C:
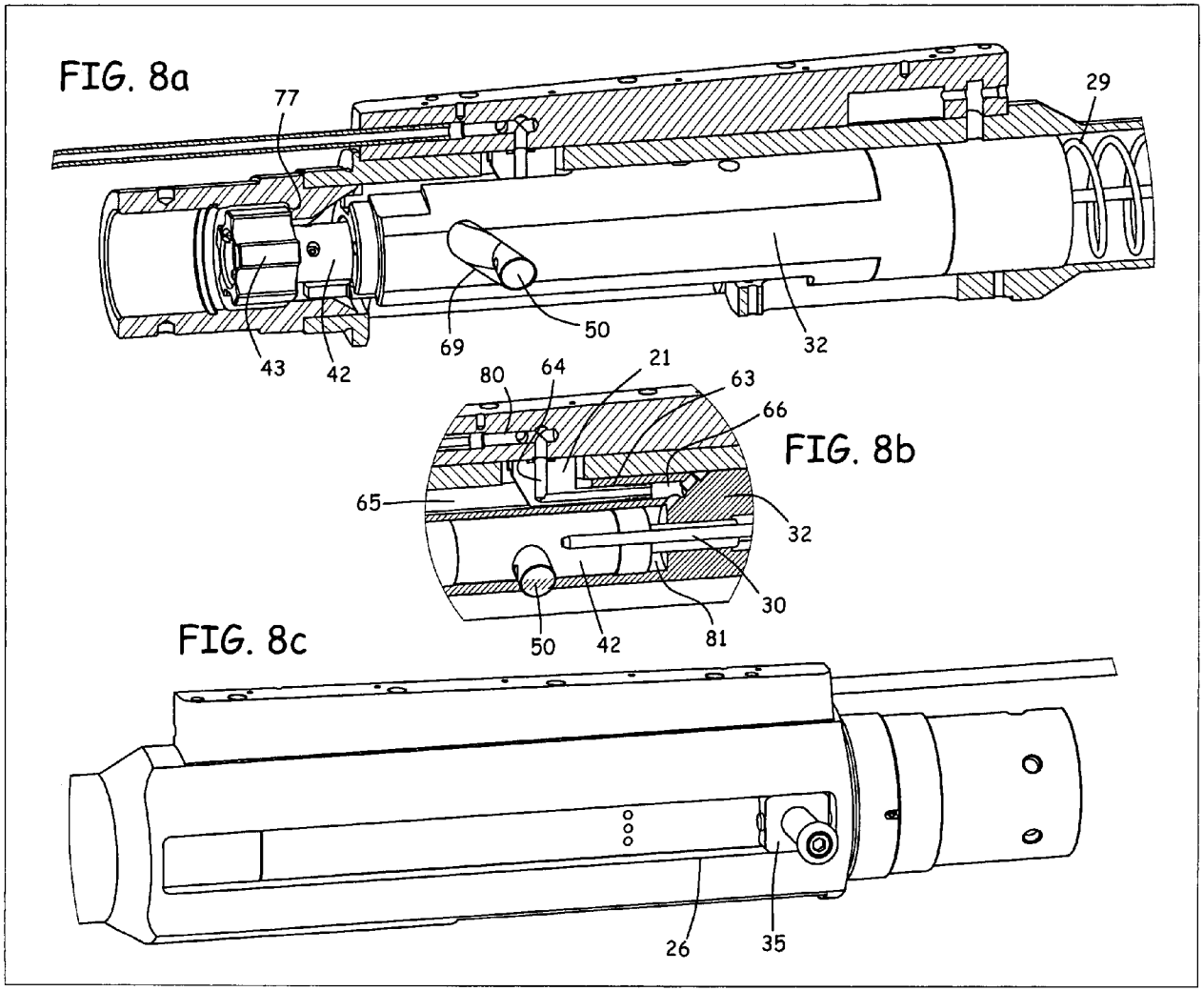
FIG. 8*a* shows a three-dimensional, partial, cutaway view of the subject invention at that point in time when the rifle action is said to be in battery, i.e., bolt lockup.
FIG. 8*b* is a detail view of the bolt cam pin and action rod interior to the bolt-carrier of FIG. 8*a*.
FIG. 8*c* shows a reverse view of that shown in FIG. 8*a*.

FIG. 8*a* shows the rifle action in battery with the bolt lugs 43 locked up against the barrel extension lugs 77, where the bolt lug bearing face 72 (not shown) bears directly on the forward face of the barrel extension lugs 77. No translation of the bolt 42 is allowed in this arrangement for safe ignition of the cartridge propellant. The action spring 29 forces the bolt-carrier 32 forward. Cam pin 50 is seated firmly to the rear of the bolt-carrier cam slot 69 causing lockup rotation of the bolt 42.

FIG. 8*b* reveals the orientation of the cam pin 50 and the bolt 42 with respect to the action rod 30. It also shows the accessory mount base gas way 80 leading into the gas-elbow gas way 64 as part of the gas-elbow 21. Notice that the gas-elbow gas tube 63 is located in the bolt-carrier gas-elbow clearance slot 65 and the bolt-carrier gas port 66 with enough clearance to allow translation of bolt-carrier 32 without interference. The piston cylinder chamber 81 is ready to receive high-pressure propellant gas to expand its volume.

FIG. 8*c*, which is a reverse view of FIG. 8*a*, shows the charging handle key 35 is stopped at the forward extreme of its travel in the ejection port 26.

Figures 9A, 9B, 9C:
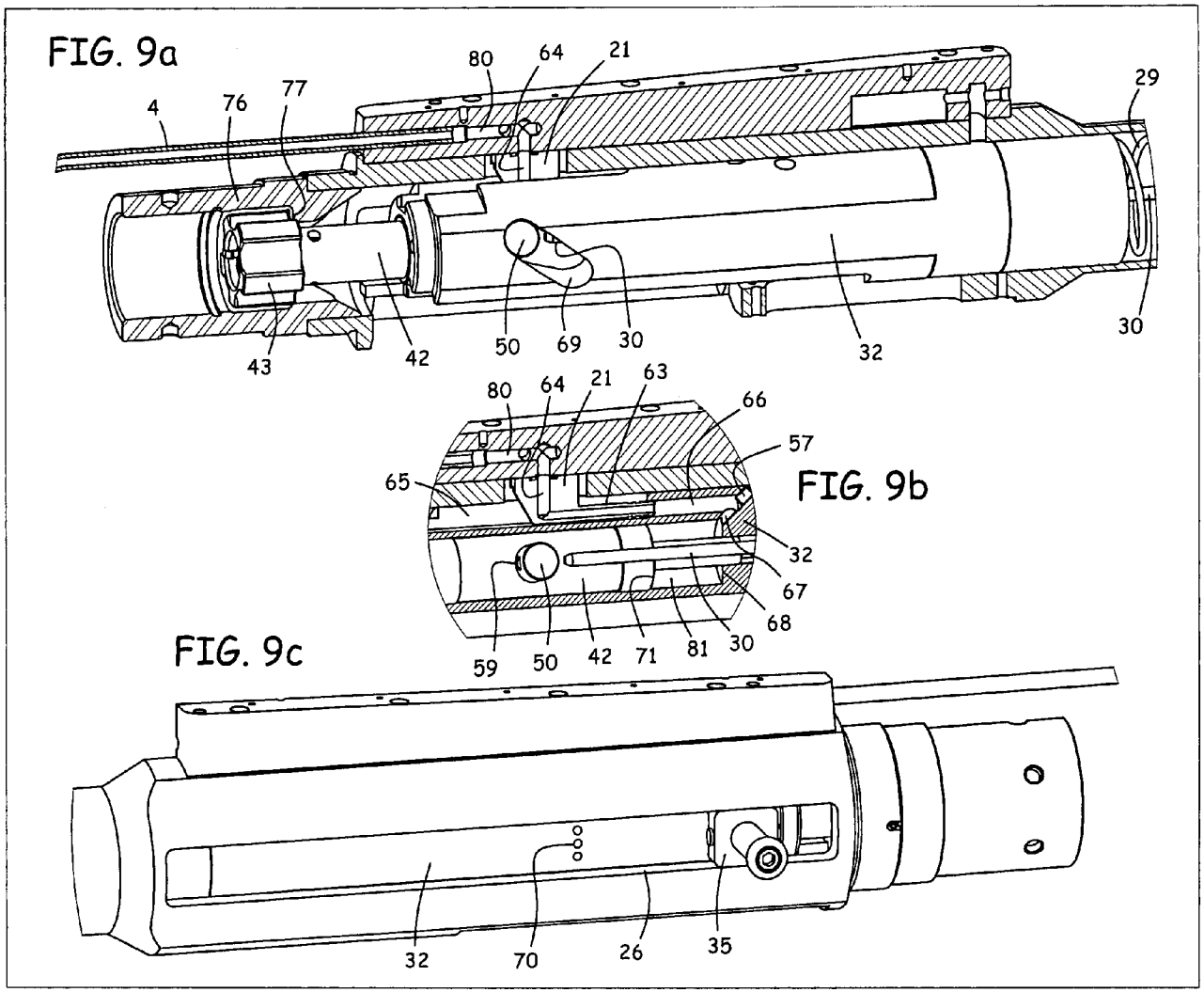
FIG. 9*a* shows a three-dimensional cutaway view of the subject invention at that point in time when the rifle action has begun to cycle and the bolt has been unlocked. Pertinent details illustrate the proper functioning of bolt rotation and bolt-carrier translation.
FIG. 9*b* is a detail view of the bolt cam pin and action rod interior to the bolt-carrier of FIG. 9*a*.
FIG. 9*c* shows a reverse view of that shown in FIG. 9*a*.

FIGS. 9*a*, 9*b*, and 9*c* show that translation of bolt-carrier 32 to the rear has occurred under the influence of high-pressure propellant gas that has entered the piston cylinder chamber 81 (see FIG. 9*b*) through the gas tube 4 (see FIG. 9*a*), the accessory mount base gas way 80, the gas-elbow gas way 64 of the gas-elbow 21, the gas-elbow gas tube 63 (see FIG. 9*b*), the bolt-carrier gas port 66, and the bolt-carrier gas way 67. Pressure acting on the bolt-carrier cylinder 68 has forced the bolt 42 to the rear overcoming the force of the action spring 29 (see FIG. 9*a*) pushing in the forward direction. The bolt-carrier cam slot 69 has rotated the bolt 42 through action of the bolt-carrier cam slot 69 and the cam pin 50. The bolt lugs 43 have rotated with the bolt 42 and are now in a disengaged arrangement with the barrel extension lugs 77 of the barrel extension 76, which is fixed to the receiver. Note that the action rod 30 (see FIG. 9*b*) is now in line with the cam pin action rod hole 59 of the cam pin 50 and can now be received by the cam pin action rod hole 59 when the bolt 42 moves further to the rear. The evident translation gap between the action rod 30 and the cam pin 50 is desirably smaller than the length, front to rear, of the barrel extension lugs 77 (see FIG. 9*a*) of the barrel extension 76, so that when the bolt lugs 43 of bolt 42 passes by the barrel extension lugs 77, the action rod 30 (see FIG. 9*b*) will be in the cam pin action rod hole 59 and prevent rotation of the bolt 42 before the bolt lugs 43 (see FIG. 9*a*) have passed completely to the rear and past the barrel extension lugs 77. At this point in the cycle, the bolt 42 is being forced against the action spring 29. Note also, that the bolt-carrier 32 (see FIG. 9*c*) cannot rotate because the charging handle key 35 is fully constrained, allowing only translation forward and rearward in the ejection port 26. Since the bolt-carrier 32 has traveled the full distance required to completely rotate the bolt 42, the bolt 42 has also translated far enough so that the bolt-carrier gas vent 70 is now exposed to the piston cylinder chamber 81 (not shown in FIG. 9*c*). The high-pressure propellant gas can now safely vent to the outside through the bolt-carrier gas vent 70. Again, the gas-elbow 21 (see FIG. 9*b*) is traveling out of the bolt-carrier gas-elbow clearance slot 65 and bolt-carrier gas port 66 without interference.

Figures 10A, 10B, 10C:
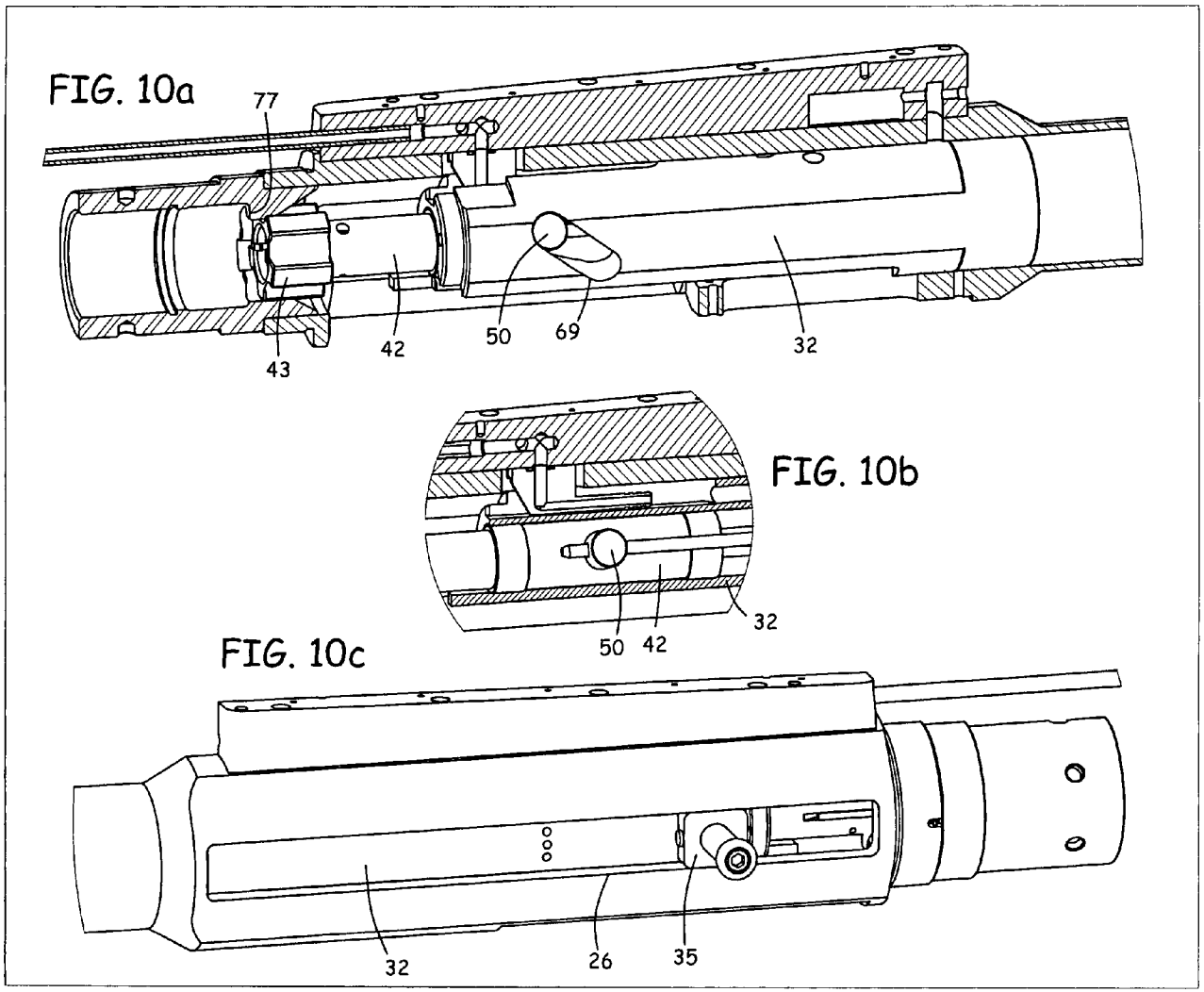
FIG. 10*a* shows a three-dimensional cutaway view of the invention subject at that point in time when the rifle action has been unlocked and the bolt-carrier has continued movement to the rear with details to illustrate interaction of certain parts necessary to proper functioning.
FIG. 10*b* is a detail view of the bolt cam pin and action rod interior to the bolt-carrier of FIG. 10*a*.
FIG. 10*c* shows a reverse view of that shown in FIG. 10*a*.

FIGS. 10*a*, 10*b*, and 10*c* show that the latent high-pressure gas in the barrel chamber 75 (not shown) has begun to push the bolt 42 to the rear by direct action. The bolt 42 in turn pushes on the bolt-carrier 32 by direct action through the cam pin 50 (see FIG. 10*a*), which bears against the rear surface of the bolt-carrier cam slot 69. In the position shown, the bolt 42 cannot rotate since the bolt lugs 43 (see FIG. 10*a*) are now located in the gaps between the barrel extension lugs 77.

FIG. 10*b* shows that the action rod 30 has pieced the cam pin action rod hole 59 of cam pin 50, further preventing rotation of the bolt 42 with respect to the bolt-carrier 32.

Of course, the bolt-carrier 32 cannot rotate because the charging handle key 35 (see FIG. 10*c*) is constrained by the ejection port 26.

Figures 11A, 11B:
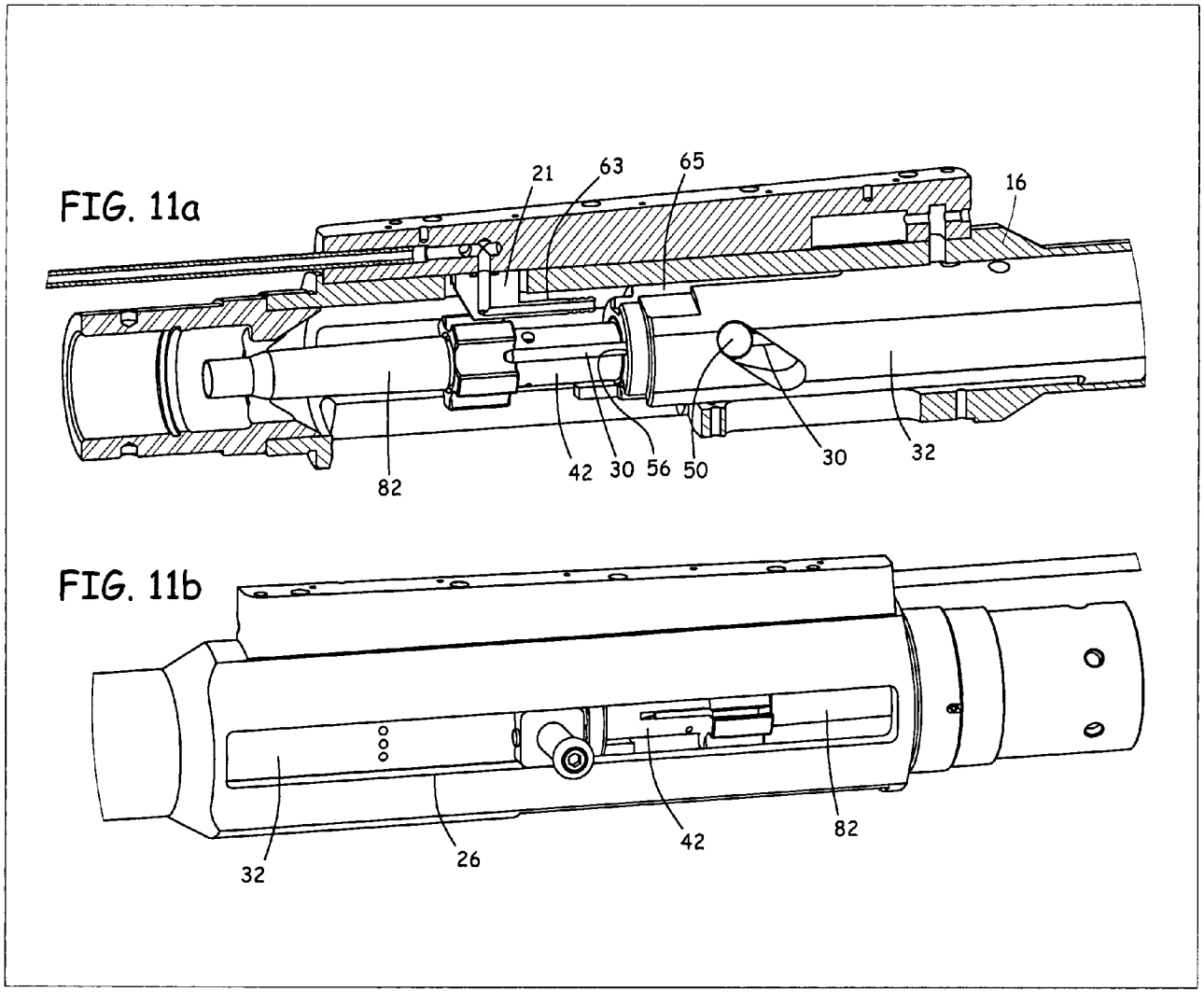
FIG. 11*a* shows a three-dimensional cutaway view of the subject invention at that point in time when the rifle action continues reciprocation and the spent cartridge is extracted from the barrel chamber with details to illustrate the proper interaction of certain features on certain parts.
FIG. 11*b* shows a reverse view of that shown in FIG. 11*a*.

FIGS. 11*a* and 11*b* show further movement to the rear of the bolt 42 and by direct action, the bolt-carrier 32 as well. Notice that the action rod 30 (see FIG. 11*a*) is extending outside of the bolt-carrier 32 through bolt-carrier action rod hole 56, through which the action rod 30 always passes. Remember that the action rod 30 is stationary with respect to the receiver 16. Note again that rotation of the bolt 42 is completely constrained by the cam pin 50, the bolt-carrier action rod hole 56, and the action rod 30. The bolt-carrier gas-elbow clearance slot 65 is now completely clear of the gas-elbow 21, which is stationary with respect to the receiver 16. The cartridge case 82, which has been added to the figure for clarity of understanding, is now visible through the ejection port 26 at the forward end. At this juncture in time, the high-pressure propellant gas has thoroughly vented from the barrel 73 (not shown) and the rest of the gas plumbing. The bolt 42 and the bolt-carrier 32 are moving under the influence of inertia only and are being slowed down by the spring 29 (not shown) pushing against the bolt-carrier 32 in the forward direction.

Figure 12A:
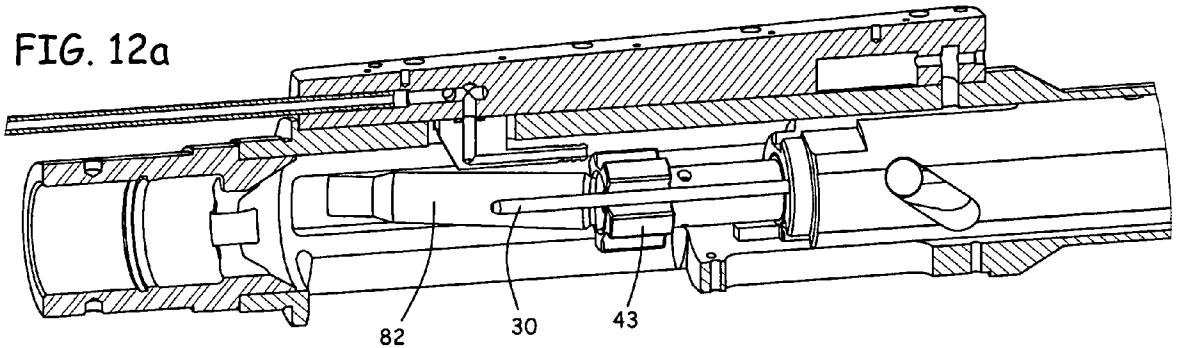
FIG. 12*a* shows a three-dimensional cutaway view of the subject invention at that point in time when the rifle action continues reciprocation and the spent cartridge is extracted and ejection begins with details to illustrate the proper interaction of certain features on certain parts.
Figure 12B:
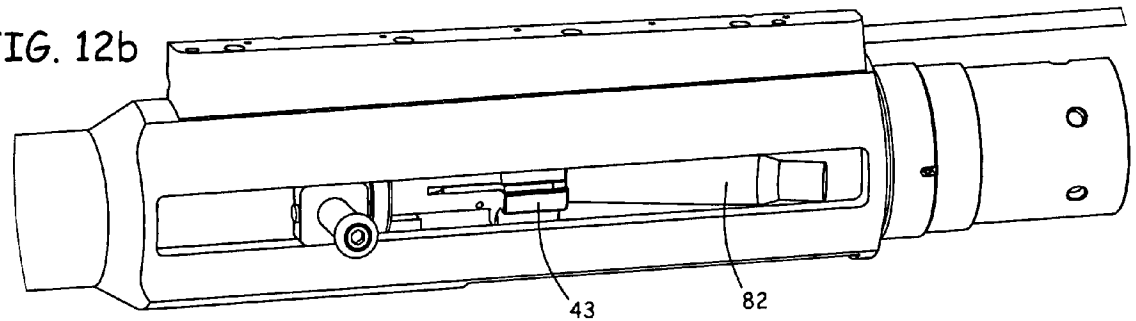
FIG. 12*b* shows a reverse view of that shown in FIG. 12*a*.

FIGS. 12*a* and 12*b* show still further movement of the action to the rear. Ejection of the cartridge case 82 has progressed. Note that the bolt lugs 43 (see FIG. 12*a*) pass by the action rod 30 as the action rod 30 lies in the gap between two of the five bolt lugs 43.

Figures 13A, 13B:
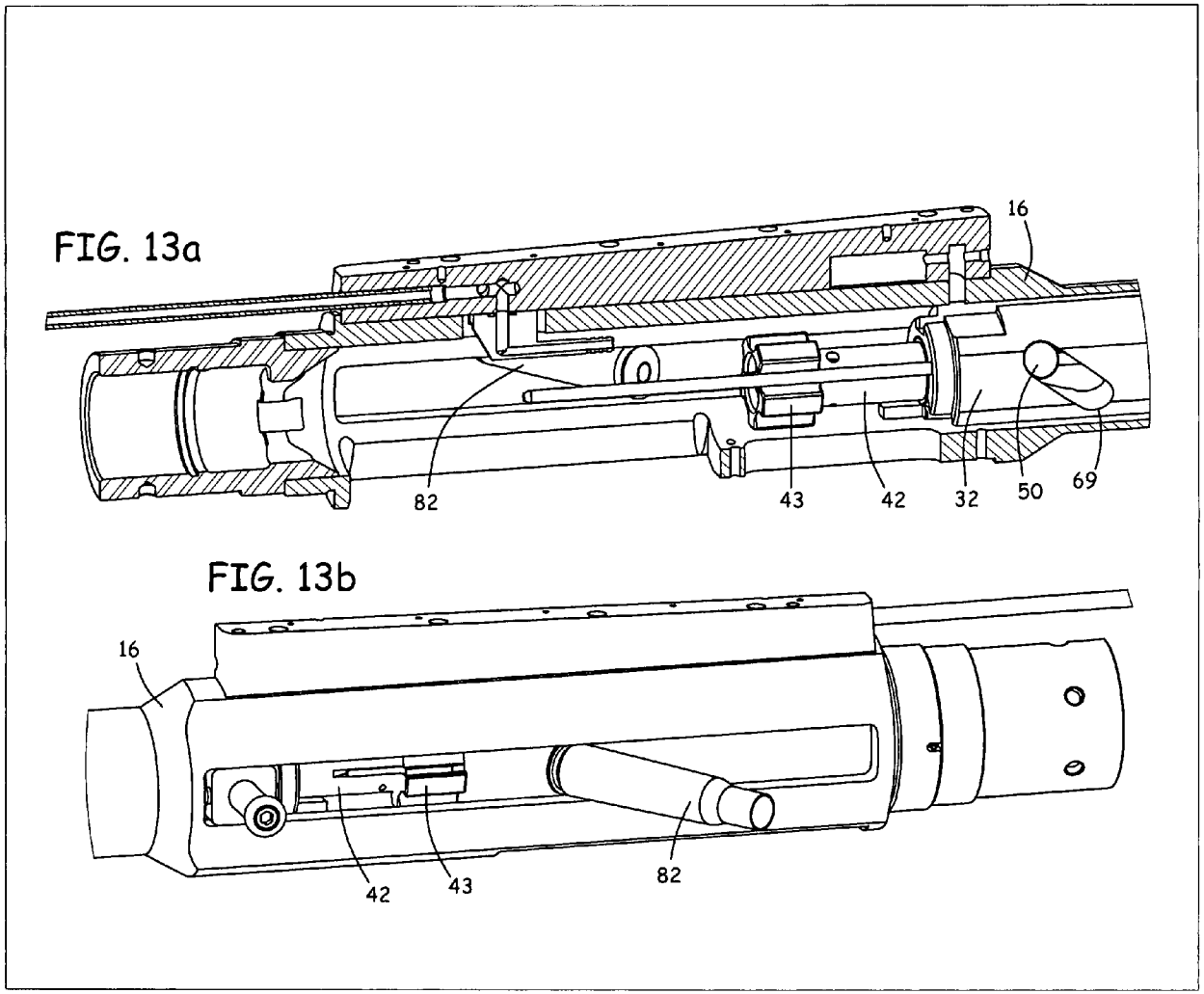
FIG. 13*a* shows a three-dimensional cutaway view of the subject invention at that point in time when the rifle action has ceased to move at the rear extreme of travel and the spent cartridge has been ejected with details to illustrate the proper interaction of certain features on certain parts.
FIG. 13*b* shows a reverse view of that shown in FIG. 13*a*.

FIGS. 13*a* and 13*b* show the movement of the bolt-carrier 32 to the rear-most extreme. The cartridge case 82 has been ejected from the receiver 16. The force developed in the action spring 29 (not shown) is now at its greatest. The action spring 29 will now begin to push the bolt-carrier 32 forward, and as it does so, the lower-most lug of the bolt lugs 43 will strip a cartridge from the detachable box magazine 10 (not shown) and push it into battery, the unlocking process above described acting in reverse to lockup the breech with regard to the rotation of bolt 42, with respect to the cam pin 50 (see FIG. 13*a*), and the bolt-carrier cam slot 69, etc.

FIG. 13*b* shows that further rearward travel of the bolt-carrier 32 is now impossible because of interference of the charging handle key 35 and ejection port 26.

Figures 14A, 14B, 14C, 14D, 14E:
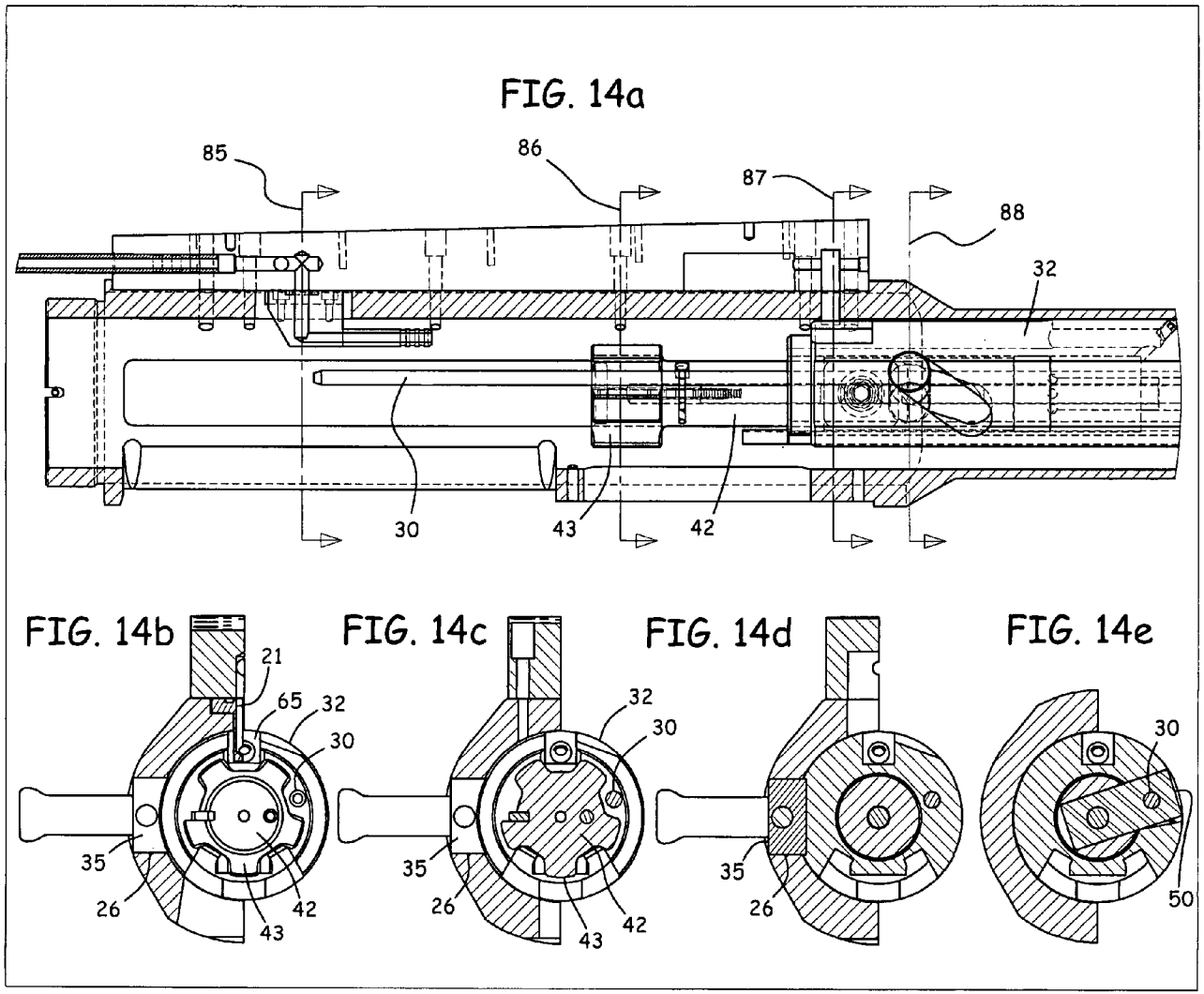
FIG. 14*a* shows a cross sectional view of the subject rifle action when in the position shown in FIG. 13*a* to highlight in more detail how the parts of the subject invention interact for proper functioning.
FIG. 14*b* is section view taken at the leftmost section plane shown in FIG. 14*a*.
FIG. 14*c* is section view taken at the second leftmost section plane shown in FIG. 14*a*.
FIG. 14*d* is section view taken at the third leftmost section plane shown in FIG. 14*a*.
FIG. 14*e* is section view taken at the rightmost section plane shown in FIG. 14*a*.

FIGS. 14*a*, 14*b*, 14*c*, 14*d*, and 14*e* show four sections of the action at its rear-most position as also shown in FIGS. 13*a* and 13*b* to illustrate more clearly the radial positions of various action components. FIG. 14*b* is taken at section plane 85 (see FIG. 14*a*). FIG. 14*c* is taken at section plane 86 (see FIG. 14*a*). FIG. 14*d* is taken at section plane 87 (see FIG. 14*a*). FIG. 14*e* is taken at section plane 88 (see FIG. 14*a*). Note that the bolt lugs 43 (FIGS. 14*a*, 14*b*, and 14*c*) are in a disengaged orientation with respect to the barrel extension lugs 77 (not shown, refer to FIGS. 7*a* and 7*b*). The gas-elbow 21 (see FIG. 14*b*) does not interfere with the bolt-carrier 32 as it passes within the bolt-carrier gas-elbow clearance slot 65. The charging handle key 35 is constrained by the ejection port 26 (see FIGS. 14*b*, 14*c*, and 14*d*). The charging handle 37 (see FIGS. 14*b*, 14*c*, and 14*d*) protrudes to allow the shooter to manually cycle the action if the gas is turned OFF or to chamber the first round. The action rod 30 (see FIGS. 14*a*, 14*b*, and 14*c*) safely clears the bolt lugs 43 passing between two adjacent lugs of the bolt lugs 43 when the bolt 42 translates to the rear with the bolt-carrier 32. The action rod 30 (see FIG. 14*e*) also pieces the cam pin 50 and the bolt-carrier action rod hole 56 (not shown in FIG. 14*e*) as described above. Careful study of these figures will thoroughly instruct anyone acquainted in the art of gun design how this semi-auto gun action functions.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A gun action assembly comprising:

a receiver;

a bolt-carrier having a cam slot, the bolt-carrier reciprocable in the receiver between battery and recoil positions;

a spring for biasing the bolt-carrier toward the battery position;

a bolt having a longitudinal axis and a cam pin, the cam pin located in the cam slot of the bolt-carrier; and an action rod fixedly attached to said receiver, the action rod having a longitudinal axis, the longitudinal axis of the action rod being offset from the longitudinal axis of the bolt;

wherein the cam pin engages the action rod during a portion of the bolt-carrier travel, the action rod preventing rotation of the bolt when the cam pin is engaged with the action rod.

2. The assembly of claim 1, wherein the bolt-carrier includes a longitudinal aperture for receiving the action rod.

3. The assembly of claim 1, wherein the longitudinal axis of the action rod is parallel to the longitudinal axis of the bolt.

4. The assembly of claim 1, wherein the cam pin includes an aperture.

5. The assembly of claim 4, wherein the cam pin aperture is laterally offset from the central longitudinal axis of the bolt.

6. The assembly of claim 4, wherein when the cam pin is engaged with the action rod, the action rod passes through the cam pin aperture.

7. The assembly of claim 6, wherein the bolt is rotatable between a battery position and a recoil position; the cam pin aperture being aligned with the action rod when the bolt is in the recoil position.

8. The assembly of claim 1, wherein the receiver further comprises an ejection port and the bolt-carrier further comprises a charging handle which passes through the ejection port, wherein the charging handle engages the ejection port to prevent rotation of the bolt-carrier.

9. The assembly of claim 1, wherein the cam pin does not protrude beyond an outer surface of the bolt-carrier.

10. The assembly of claim 1, wherein the receiver is made from a tubular member.

11. The assembly of claim 1, wherein the action rod comprises an elongate member fixedly attached at one end to a recoil plate, the recoil plate being fixed to the receiver.

12. The assembly of claim 1, wherein the receiver further comprises a cartridge ejection port;

the bolt-carrier further comprises a charging handle, the charging handle extending through the cartridge ejection port;

wherein the charging handle prevents rotation of the bolt-carrier within the receiver.

13. The assembly of claim 12, wherein the charging handle is slidably engaged with the receiver within the cartridge ejection port.

14. The assembly of claim 12, wherein a portion of the charging handle contacts a portion of a wall surface of the receiver.

15. The assembly of claim 1, wherein the longitudinal axis of the action rod is parallel to a longitudinal axis of the bolt-carrier.

16. The assembly of claim 1, wherein the action rod prevents rotation of the bolt about its longitudinal axis when the cam pin is engaged with the action rod.

17. The assembly of claim 12, wherein a cartridge case may be ejected from the gun action assembly through the cartridge ejection port.

18. The assembly of claim 12, wherein the charging handle may be used to manually actuate the bolt-carrier.

19. The assembly of claim 1, further comprising a gas elbow fixedly attached to the receiver, the gas elbow having a gas way; wherein gas pressure may be directed by the gas elbow to initiate recoil of the bolt-carrier.

20. The assembly of claim 19, wherein the gas elbow further comprises a gas tube.

21. The assembly of claim 20, wherein the bolt-carrier further comprises a gas port which receives the gas tube when the bolt-carrier is in the battery position.

22. The assembly of claim 19, further comprising an adjustable gas valve.

23. The assembly of claim 19, wherein the bolt-carrier includes a gas vent.

24. The assembly of claim 19, wherein the receiver further includes a variable decline angle accessory mount.

* * * * *